United States Patent [19]

Hirsch et al.

[11] Patent Number: 4,854,240

[45] Date of Patent: Aug. 8, 1989

[54] TWO-STAGE SHAPED CHARGE PROJECTILE

[75] Inventors: Eitan Hirsch, Netanya; Alexander Gutmann, Raanana; Ana Schwartz, Ramat Hasharon; Eliezer Goren, Even Yehuda; Nikolai Perlmuter, Netanya; Reuven Tal, Kiron, all of Israel

[73] Assignee: The State of Israel, Ministry of Defence, Israel Military Industries, Israel

[21] Appl. No.: 136,095

[22] Filed: Dec. 21, 1987

[30] Foreign Application Priority Data

Dec. 25, 1986 [IL] Israel ..... 81097

[51] Int. Cl.[4] ..... F42B 13/12

[52] U.S. Cl. ..... 102/476; 102/308

[58] Field of Search ..... 102/306–310, 102/473, 476

[56] References Cited

U.S. PATENT DOCUMENTS

| | | | |
|---|---|---|---|
| 4,368,660 | 1/1983 | Held . | |
| 4,606,272 | 8/1986 | Kerdraon | 102/476 |
| 4,714,022 | 12/1987 | Chaumeau et al. | 102/476 |

FOREIGN PATENT DOCUMENTS

| | | | |
|---|---|---|---|
| 161390 | 6/1988 | European Pat. Off. . | |
| 2460303 | 10/1978 | Fed. Rep. of Germany | 102/476 |
| 2552870 | 4/1985 | France | 102/476 |
| 1051407 | 12/1966 | United Kingdom | 102/476 |
| 1581125 | 12/1980 | United Kingdom . | |

OTHER PUBLICATIONS

Proceeding of the 7th International Symposium on Ballistics, The Hague, Apr. 1983; ADPA, pp. 251–256.

*Primary Examiner*—Harold J. Tudor

*Attorney, Agent, or Firm*—Steinberg & Raskin

[57] ABSTRACT

A two-stage, shaped charge projectile having a rear principal charge and a front secondary smaller charge with an initiator-fuse assembly for sequentially igniting the secondary and principal charges so that the secondary charge is first ignited, followed by ignition of the principal charge after a predetermined time delay. The secondary charge is maintained at a set distance in front of the principal charge which is shielded from rearwardly expanding combustion gases and rearwardly flying debris when the secondary charge is ignited, with these gases and debris being diverted away from the principal charge after the secondary charge has been detonated.

8 Claims, 4 Drawing Sheets

Fig. 3
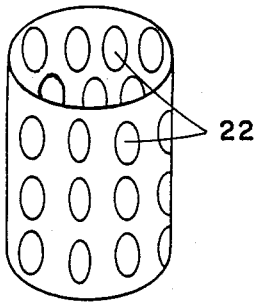
Fig. 4
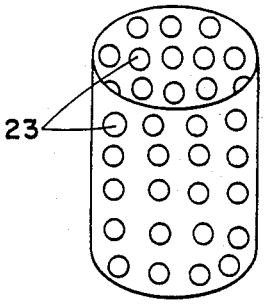
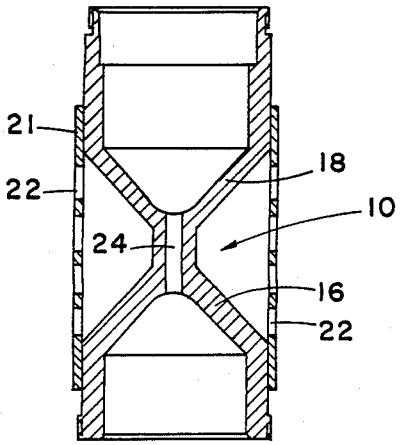
Fig. 5
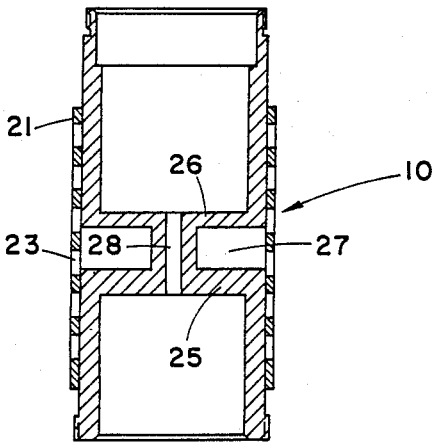
Fig. 6

TWO-STAGE SHAPED CHARGE PROJECTILE

BACKGROUND OF THE INVENTION

The present invention concerns shaped charge projectiles adapted to defeat targets fitted with reactive and passive armour in combination. A reactive armour comprises explosive charges sandwiched between metal plates and adapted to be detonated upon being activated by an oncoming projectile, e.g. a shaped charge projectile, whereby the metal plates of the reactive armour are thrown in opposite directions thereby preventing the penetration of the so-called jet, (also referred to in the art as "prong" or "spike") of the shaped charge. Reactive armours of this kind are described, for example, in U.S. Pat. No. 4,368,660, B.P. 1,581,125 as well as European Patent Application No. 85 101 340.9 published on Nov. 21, 1985 under U.S. Pat. No. 0,161,390.

Reactive armour, in particular of the kind described in the above-mentioned European Patent Application No. 85 101 340.9, is added on the main body, passive armour ont he outer side thereof and it successfully averts the capacity of a shaped charge to penetrate the passive armour. In this way a decisive advantage is imparted to attacking tanks and armoured vehicles fitted with such an armour. In an effort to overcome this problem, it has already been proposed to use against reactive armour two-stage projectiles with two aligned shaped charges, an aft principal charge and a fore, smaller secondary charge (see, for example, Proceedings of the 7th International Symposium on Ballistics, The Hague, April 1983, American Defence Preparedness Association (ADPA), pp 251–256). Upon detonation the secondary shaped charge initiates the reactive armour thereby causing it to detonate and this is intended to pave the way for the jet of the principal charge that forms upon detonation of the latter after a predetermined time delay. However, all these attempts have so far not led to a useful product, among others for the reason that the problem of avoiding the adverse effect of the detonating secondary charge on the yet undetonated principal charge caused by reaction forces, rearward expanding combustion gases and rearward flying debris was not solved. In view of this, in the hitherto made proposals the time delay between detonation of the secondary and principal charges had to be very short within the order of small fractions of 1 m.sec. in order to avoid the development of any damaging effect of the exploding secondary charge on the principal charge, which would develop if the delay were longer. Such short delays, however, do not enable a full disposal of the reactive armour prior to the initiation of the principal charge with the consequence that the desired effect is not achieved.

SUMMARY OF THE INVENTION

It is the object of the present invention to overcome this problem and provide two-stage shaped charge projectiles adapted to penetrate an armour assembly comprising an outer, reactive armour and an inner, passive armour.

In accordance with the present invention there is provided a two-stage shaped charge projectile comprising an aft, principal shaped charge and aligned fore secondary, smaller shaped charge, an initiator-fuse assembly adapted to ignite said principal and secondary shaped charges sequentially such that the secondary shaped charge is first ignited and the principal shaped charge is ignited after a predetermined time delay, means for activating said initiator-fuse assembly at a predetermined stand-off of the projectile from the target, characterized by connector means situated between said principal and secondary shaped charges, which connector means hold the said secondary shaped charge at a desired distance from said principal shaped charge, said connector means comprising a guard member for shielding the principal charge from rearward expanding combustion gases and rearward flying debris, and further comprises means for diverting away from said guard member rearward expanding combustion gases emanating from said secondary shaped charge upon detonation thereof.

Due to the special design of the connector means it is possible, in accordance with the invention, to preset the time delay between the detonation of the secondary and principal charges sufficiently long, e.g. in excess of 1 m.sec., to ensure that the reactive armour is disposed of prior to initiation of the principal charge.

The said guard member may be flat or profiled, e.g. dome or cone shaped.

The means by which the combustion gases expanding from the detonating secondary shaped charge are diverted away from said guard member may be of various different designs. In accordance with one embodiment, said connector means comprise in front of said guard member, wall means adapted to be burst by the shock wave produced by rearward expanding combustion gases arriving by the detonating secondary shaped charge, whereby the expanding gases escape sidewards. By another embodiment a portion of said connector means in front of said guard member is perforated or slotted whereby the expanding combustion gases arriving from the detonating secondary charge can escape sidewards.

If desired, bores or holes may be provided in the connector means for leading therethrough electric wires or a pyrotechnical train forming part of the initiator-fuse assembly.

If desired, the connector means may be covered by a cylindrical sleeve adapted to be burst by the expanding combustion gases of the secondary charge and serving for improving the aerodynamic characteristics of the projectile. Further if desired, such sleeve may be perforated or slotted to facilitate the escape of the expanding combustion gases.

The connector means in a two-stage shaped charge projectile according to the invention may be made of any suitable material capable of affording the strength required to provide the necessary structural stability, e.g. steel, aluminum, a tough synthetic material that does not soften under operational conditions, etc.

The two-stage shaped charge projectile according to the invention may be in form of a selfpropelled missile or in form of a shell shot from launching means such as a mortar or gun.

In a two-stage shaped charge projectile according to the invention the initiator-fuse assembly is initiation at a desired, preset stand-off from the target either physically, e.g. by means of a prong or by a proximity initiation device. During the delay between the initiation of the secondary shaped charge and the principal shaped charge, the jet from the detonating secondary charge initiates the reactive armour which upon detonation is removed from the path of the main jet produced upon detonation of the principal charge. In consequence, the main jet can penetrate the passive armour unobstructedly. Depending on the design of the reactive armour the time delay required between the initiation of the two shaped charges may be relatively long and for achieving the required penetration effect into the passive armour it is necessary that during detonation of the reactive armour the trajectory of the remaining projectile remains unaffected and that the principal shaped charge remains intact. These requirement are met for the first time in accordance with the present invention.

During the time delay between the initiation of the secondary and principal shaped charges, the projectile with the intact principal charge continues to move towards the target with a typical velocity of about 200 m. per second or even higher. In order to ensure that the moving parts of the reactive armour which are set into motion by detonation of the explosive charge thereof due to initiation by the secondary, fore shaped charge, will not hit the projectile with the intact principal shaped charge, it is necessary to initiate the fuse while the fore, secondary shaped charge is still at a large enough stand-off from the target. The required delay and consequential stand-off depends, among others, on the design of the reactive armour and the angle of attack and cannot be predicted for each individual case. As a practical matter it has been found that a stand-off of about 1–2 m. is adequate for most cases.

As a rule the fore, secondary shaped charge may not be too heavy for two reasons. For one, increasing the weight of this charge would be a trade-off against the weight of the aft, principal shaped charge. As, however, the latter is responsible for the final kill such a trade-off is undesirable. Moreover, the larger the secondary shaped charge the stronger the shock wave created thereby which the intact principal shaped charge will have to sustain until detonation. Reduction of the size of the fore, secondary shaped charge has to be compensated by accuracy of its design so that it will still have the required initiating effect on the reactive armour at a stand-off of from 1 to 2 m.

BRIEF DESCRIPTION OF THE DRAWINGS

For better understanding the invention will now be described with reference to the annexed drawings in which:

FIGS. 3 and 4 are perspective views of sleeves for mounting on connector means in two-stage projectiles according to the invention;

FIGS. 5, 6 and 7 are longitudinal sections through three further embodiments of connector means for use in two-stage projectiles according to the invention;

DESCRIPTION OF THE PREFERRED EMBODIMENTS

Figure 1:
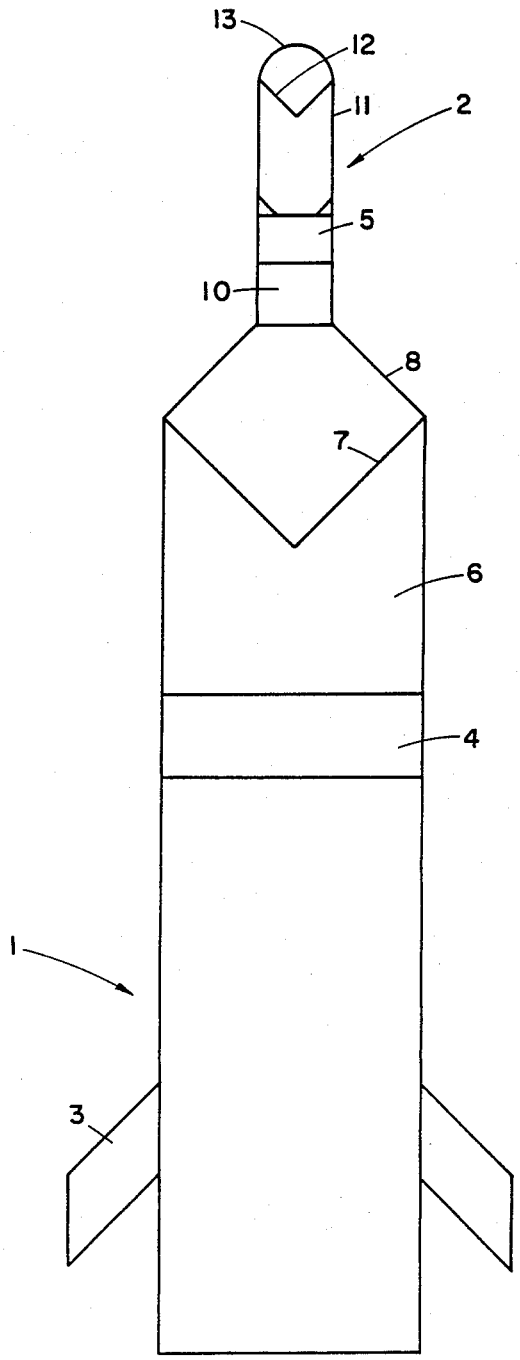
FIG. 1 is a diagrammatic illustration of a two-stage projectile according to the invention in which the various sections are diagrammatically outlined.

The two-stage shaped charge projectile according to the invention shown in FIG. 1 is in the form of a missile rocket comprising a main, aft body section 1 and a head section 2. Section 1 is fitted with stabilizing fins 3 and contains the missile engine (not shown). The missile comprises a proximity fuse assembly 4 designed for initiation by a proximity initiator device (not shown) of a kind known per se.

In front of the fuse 4 there is located the aft, principal shaped charge confined between the fuse 4 and a liner 7 covered by an ogive 8.

Between the main body section 1 and head section 2 there is located a connector 10. The head section 2 contains the fore, secondary shaped charge 11 confined between an initiator 5 and a liner 12. The tip of head section 2 is sealed by an aerodynamic cover 13.

Figure 2:
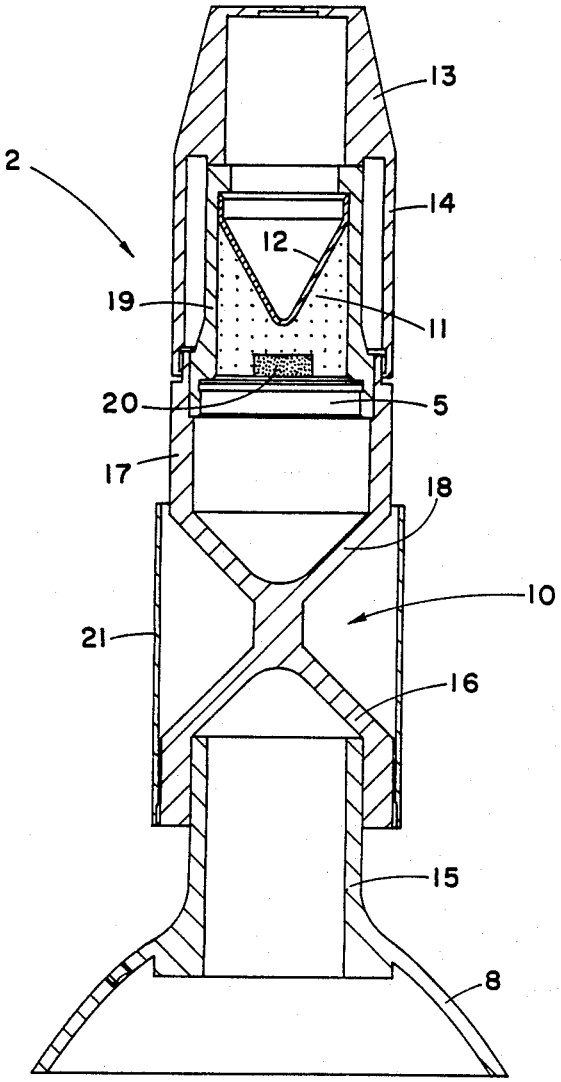
FIG. 2 is an axial section through the head portion of a projectile according to the invention.

The head section 2 of the two-stage shaped charge missile according to the invention illustrated diagrammatically in FIG. 1, is shown in FIG. 2. As shown the ogive 8 comprises a tubular adaptor 15 on which is mounted a spider-like connector 10 comprising a guard member 16 serving for shielding the principal shaped charge (not shown in FIG. 2), and a fore, cup-shaped portion 17 having a conical bottom portion 18 and holding in tight fit the aerodynamic cover 13 via a cylindrical skirt 14 thereof.

Resting on an inner circumferential shoulder of the cup portion 18 of connector 10 is a sleeve 19 holding initiator 5. The fore, secondary shaped charge 11 is confined between initiator 5 and liner 12. There is further provided an accelerator or booster charge 20.

In operation the proximity fuse activates initiator 5 and by it the fore, secondary shaped charge 11 via booster charge 20 and simultaneously therewith it also activates a delay mechanism which in turn activates the aft, principal shaped charge 6 of the missile (see FIG. 1) after a predetermined time delay.

Connector 10 is enclosed within a sleeve 21 whose main object is to impart to the connector the desired aerodynamic characteristics.

The design of the proximity fuse 4, initiator 5 and the principal shaped charge 6 are all conventional and need not be described in detail.

Upon initiation of the fore, secondary shaped charge 11 in the manner specified, the shock waves resulting from the rearward directed combustion gases of the detonating charge 11 act on the conical bottom portion 18 of connector 10 whereby that portion is burst and the expanding combustion gases are diverted sidewards, gliding along the slanted surface of the conical guard member 16. In consequence of such bursting, the entire front part of head section 2 is blown off while the guard member 16 and the entire main portion of the missile with the aft, principal shaped charge 6 and the engine remain intact and maintain their original trajectory. The guard member 16 protects the main missile section both against debris and against damage by the combustion gases expanding from the detonating fore, secondary shaped charge 11.

Upon bursting of the conical bottom portion 18, sleeve 21 is equally blown off. If desired, the sleeve may comprise openings for gas passage by being perforated or slotted.

The connector 10 shown in FIG. 5 is essentially similar to that of FIG. 2, having however in addition an axial bore 24 serving for the passage of electric wires or a pyrotechnic train of the delay mechanism. The protective sleeve 21 in the embodiment of FIG. 5 is of the kind shown in FIG. 3, comprising a plurality of oval holes 22.

In the embodiment of FIG. 6 the conical guard 16 and the conical bottom portion 18 of the cup-shaped upper part of the connector are replaced by, respectively, a flat transversal guard member 25 and a flat transversal bottom 26 with an intervening annular recess 27. Like in the embodiment of FIG. 5 there is provided an axial bore 28 for the accommodation of electrical wires or a pyrotechnical train of the delay mechanism. The protective sleeve 21 here is of the kind shown in FIG. 4 with a plurality of circular holes 23.

Figure 7:
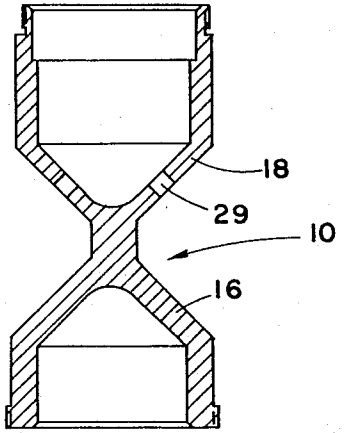

The embodiment of connector for a two-stage shaped charge projectile according to the invention shown in FIG. 7 is essentially the same as that of FIG. 2 with the sole difference that in this case the conical bottom 18 comprises holes 29 serving both for facilitating the expansion of the combustion gases arriving from the detonating fore, secondary shaped charge 11 and for the passage of electric wires or a pyrotechnical train of the delay mechanism.

Figure 9:
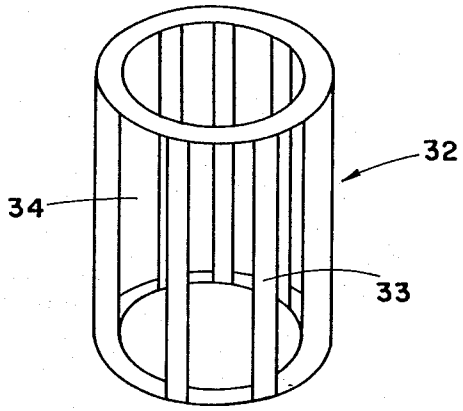
FIG. 9 is a perspective view of a further embodiment of a sleeve for mounting on connector means in two-stage projectiles according to the invention.
Figure 8:
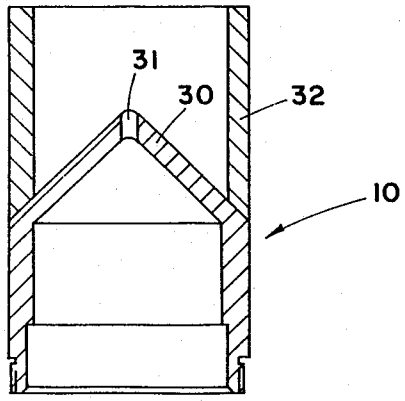
FIG. 8 is an axial section through a further embodiment of connector means for use in two-stage projectiles according to the invention.

In the embodiment of FIGS. 8 and 9 the connector 10 comprises a guard member 30 of similar design as member 16 in the connector of FIG. 2 and has a central bore 31 for the passage of electric wires or a pyrotechnical train of the initiator-fuse assembly. The connector further comprises an intermediary cagelike cylindrical member 32 comprising a plurality of axially oriented bars 33 and slots 34. In front of the intermediary member 32 there will be mounted in any suitable manner the fore, secondary shaped charge 11.

We claim:

1. A two-staged shaped charge projectile, comprising an aft body section holding an aft, principal shaped charge, an aligned head body section holding a fore, secondary shaped charge that is smaller than said principal shaped charge, an initiator-fuse assembly adapted to initiate said aft and fore shaped charges sequentially such that the fore shaped charge is first initiated and the aft shaped charge is initiated after a predetermined time delay, and means for activating said initiator-fuse assembly at a predetermined stand-off of the projectile from a target, the improvement comprising connector means provided for connecting said aft and fore body sections and holding the same at a desired distance from one another, said connector means comprising a substantially X-profiled double cone structure with fore and aft conical chambers serving as guard members, said aft guard member being designed for shielding the aft shaped charge from rearward expanding combustion gases and rearward flying debris, while said fore guard member is designed for being burst by the rearward expanding propellant gases of the detonated for shaped charge, whereby said gases and debris escape to the surrounding atmosphere.

2. The projectile of claim 1, wherein said connector means are the only interconnection between said fore and aft body sections.

3. The projectile of claim 1, wherein said connecting means are arranged together with said fore and aft body sections, to provide a predetermined time delay in excess of 1 m.sec. between detonation of the fore, secondary shaped charge and the aft, principal shaped charge.

4. A two-staged shaped charge projectile according to claim 1, wherein said connector means comprise at least one bore or hole for the passage of electrical wires or a pyrotechnic train forming part of the initiator-fuse assembly.

5. A two-stage shaped charge projectile according to claim 1, wherein said connector means are surrounded by a sleeve.

6. A two-stage shaped charge projectile according to claim 5, wherein said sleeve comprises openings for gas passage.

7. A two-stage shaped charge projectile according to claim 6, wherein said sleeve is perforated.

8. A two-stage shaped charge projectile according to calim 7, wherein said sleeve is slotted.

* * * * *